US005615569A

United States Patent [19]

Schlatter

[11] Patent Number: 5,615,569

[45] Date of Patent: Apr. 1, 1997

[54] WOBBLE PRESS

[75] Inventor: Walter Schlatter, Schaan, Liechtenstein

[73] Assignee: Colcon Anstalt, Vaduz, Liechtenstein

[21] Appl. No.: 361,385

[22] Filed: Dec. 22, 1994

Related U.S. Application Data

[63] Continuation-in-part of Ser. No. 30,039, Apr. 1, 1993, Pat. No. 5,398,536.

[30] Foreign Application Priority Data

Jul. 22, 1991 [CH] Switzerland ..... 2214/91

[51] Int. Cl.[6] ..... B21J 9/18

[52] U.S. Cl. ..... 72/67; 74/590

[58] Field of Search ..... 72/67, 112, 115, 72/406; 74/590, 591

[56] References Cited

U.S. PATENT DOCUMENTS

| | | | |
|---|---|---|---|
| 4,984,443 | 1/1991 | Sato et al. . | |
| 5,398,536 | 3/1995 | Schlatter | 72/406 |

FOREIGN PATENT DOCUMENTS

| | | |
|---|---|---|
| 1652653 | 5/1972 | Germany . |
| 52-848 | 4/1977 | Japan . |
| 284452 | 11/1989 | Japan . |
| 317650 | 12/1989 | Japan . |
| 0051954 | 11/1966 | Poland . |
| 0662983 | 11/1987 | Switzerland . |
| 0666857 | 8/1988 | Switzerland . |
| 1005990 | 3/1983 | U.S.S.R. . |

OTHER PUBLICATIONS

Patent Abstract of Japan, vol. 14, No. 58 (M–930) (4001) 2.
International Search Report and Annex.

*Primary Examiner*—Lowell A. Larson
*Attorney, Agent, or Firm*—Greenblum & Bernstein P.L.C.

[57] ABSTRACT

In a wobble press with a first wobbling die-half and an axially parallel moving second half-die, the wobbling motion is generated by a plurality of hydraulically actuated working pistons cyclically engaging with the wobbling half-die and by means of the elimination of centrifugal forces by a counterweight (G) connected to the wobbling half-die, the precise guiding of the die-halves by a centering disk and the avoidance of a mechanical drive by using a multiple-pistons pump and a hydraulic control system for the working pistons, it is possible to reduce undesirable rotary forces, vibration, friction and heat generation in such a way that substantially higher wobble frequencies and shorter processing times are attained at lower cost while maintaining the geometrical wobble effect owing to the higher wobble frequency, with a simple and rapidly acting control of the extent and form of the wobbling movement even during operation, thus making it possible to preselect the most suitable pressing program.

13 Claims, 6 Drawing Sheets

WOBBLE PRESS

CROSS REFERENCE TO RELATED APPLICATIONS

This application is a continuation in part of U.S. patent application Ser. No. 08/030,039, filed Apr. 1, 1993,now U.S. Pat. No. 5,398,536 granted Mar. 21, 1995.

BACKGROUND OF THE INVENTION

1. Field of the Invention

This invention pertains to a wobble press having a first die half which is driven by a drive, relative to the longitudinal axis of the press, wobbly around a fulcrum point, and which includes a movable second half die axially parallel relative to the first die half wherein the wobble drive includes hydraulic working pistons which are provided with a regular, defined, pulsating flow of a hydraulic medium and which on their part are connected with the first die half for the generation of a wobble movement.

2. Discussion of the Background of the Invention and Material Information

Such a wobble press is, for example, shown in Swiss Patent Publications CH 662983 and CH 666857 or German Patent Publication DE 1652653 as well as U.S. Pat. No. 4,984,443 to Sato et al and serves for the production of massive parts of metal or other rigid materials, wherein the part or the workpiece is formed between two enveloping tools or die parts wherein, in opposition to the parallel axial press methods the one die half carries out a rolling type of wobbly movement. Due to the partial contact of the upper die with the workpiece material the workpiece material can, via the wobble movement be brought to movement with substantially less press force so that in one step substantially greater degrees of deformation and a more exacting forming of the matrix contours may be achieved. The possible feed advance during contact is determined by the angle of inclination of the wobbling tool and is thus correspondingly limited. The magnitude of this advance determines the total working stroke, i.e., for the desired degree of forming the required number of wobble passes and the corresponding wobble frequency determines the time of forming.

In known wobble presses, the utilization of mechanical drives for the wobble movement limits the rotational frequency or wobble frequency through a number of factors:

In the transverse setting of the wobbling tool disturbing centrifugal forces originate which particularly emanate also from the large mass of the eccentric shaft and the eccentric drive components. These free forces produce prohibitive vibrations, at higher wobble frequencies, between the tool parts, thus restricting the wobble frequency in known wobble presses to low values.

The cup shaped bearing of the wobbling tool must in addition thereto absorb the entire press thrust. Due to the cup shaped formation of the upper pressure bearing the bearing pressure increases per unit area and thus considerably increases the work produced due to friction. The thus produced frictional heat must be removed through a thin oil film from the bearing clearance. With increasing wobble frequencies the friction heating increases in an analog manner, which heat must be removed through the lubricating means. On the other hand, the narrow bearing clearance limits the through-put flow of the lubrication and cooling means.

The insufficient heat removal and the centrifugal forces of the off center mass prohibit, in known constructions, the utilization of wobble frequencies more than approximately 600 revolutions per minute. If the permitted advance per wobble cycle is not exceeded, workpieces of medium dimension are turned out in forming times of approximately 4 to 5 seconds with a corresponding production capacity of only 10–12 parts per minute. Trials at this limited wobble frequency to reduce deformation time via the increase in the closing speed of the press, did however lead to an increase in the contact area between the workpiece and the wobble tool. In this instance a total press force would be required which is the same magnitude as in axially parallel presses so that the wobble press can in this instance not provide an essential advantage.

SUMMARY OF THE INVENTION

One task or object of the invention is to eliminate the noted deficiencies of the prior art and to provide a wobble press which permits a continuous operation with increased wobble frequency and a reduction of the shaping time of a workpiece specifically also in the mid range and the warm range.

Another object of this invention is to reduce or avoid the centrifugal forces caused by the eccentricity of the center of gravity of the upper die half during the wobbling movement of upper die.

A further object of at least some of the embodiments of this invention, where the counterweight is located on the same side of the fulcrum of the tool, is to reduce the tilting moments which occur during the wobbling movement due to the inclination of the tool of upper die half with respect to longitudinal press axis.

An additional object of this invention is to eliminate or at least reduce any tipping or tilting moments at the first die half by arranging the means for connecting the counterweight to the upper die half at the height of the center of gravity of the upper die half.

According to one embodiment of this invention, a first wobble driven die half which is connected with a counterweight and is thusly shaped and arranged that its center of gravity is moved 180° to the opposite side of the fulcrum point as the center of gravity of the first die half and that the product of its mass and distance to the center of gravity from the fulcrum point corresponds approximately to the product of the mass of the first die half and the distance to the center of gravity from its fulcrum point.

Since the center of gravity of the counterweight is moved 180° opposite to the center of gravity of the wobbling tool and since the products of the mass and the distance from the center of gravity cancel each other, no centrifugal forces can occur in the light of the off center location of the wobbling tool and the centrifugal forces are automatically eliminated during all wobble frequencies, wobble amplitudes and angles of inclination.

With another embodiment of this invention, the compensation of the forces due to inertia of the wobbling tools can be achieved in that a movable mass is proposed on the same side as fulcrum point tool. Through the movement of the counterweight to the extent of the eccentric movement of the tool to the opposing side of the center axis the necessary counter force can be produced whereby the movement of the counter mass can be achieved via a connecting structure as a function of the eccentric movement.

The invention rests upon the manifestly not considered knowledge that the disadvantages of the prior art can be to a large degree obviated via the compensation of the centrifugal forces of the wobbling so that the wobble press can be operated at an increased frequency.

In a practical embodiment of the inventive wobble press, in continuous production, frequencies of about 2400 revolutions per minute and with a reduction in the deformation time to approximately 1–1.5 seconds were achieved without interfering vibrations. This short shaping time permits the expansion of wobble presses into the area of hot forming without apprehension that the tools, due to a long exposure time with the heated material wear uneconomically and at the same time that the material is subject to premature cooling during the shaping operation.

It is particularly advantageous to have exact guidance of the two die halves even with off center material distribution which can be assured in one embodiment of this invention in that the first die half is operatively coupled with a centering plate thus producing a practically clearance free centralization with the other die half.

In a particularly advantageous further development of the present invention the wobble drive of the first die half has at least three wobble pistons surrounding a wobble axis which are supplied via a multiple pump periodically with a cyclically varying pressure medium. Advantageously this cyclical variation is produced via two coacting axial piston pumps with rotating angled wobble plates which affect a number of pump pistons which in turn are connected via hydraulic conduit with one each of the associated wobble pistons.

Specifically, one embodiment of the wobble press of this invention comprises in combination: a first die half; a movable second die half axially parallel relative to the first die half; means for wobbly driving the first die half, having a mass and a center of gravity. $S_o$, with regard to a longitudinal central axis (A) of the press, wobbly around a fulcrum point (M), the wobble drive means including hydraulic working pistons which are provided with a regular, defined, pulsating flow of a hydraulic medium, the hydraulic working pistons being connected with the first die half for the generation of a wobble movement; a counterweight (G), having a mass and a center of gravity ($S_u$), connected to the first wobbly driven die half, the counterweight (G) being so structured and arranged that the product of the mass of the counterweight (G) and the eccentricity spacing ($E_u$), of the spacing of the center of gravity ($S_u$) of the counterweight (G), relative to longitudinal axis (A), at least approximately corresponds to the product of the mass of the first die half and the eccentricity spacing ($E_o$), of the spacing of the center of gravity ($S_o$) of the first die half, relative to longitudinal axis (A), so that the centrifugal forces of both the counterweight (G) and the first die half at least approximately compensate each other.

In another embodiment of the wobble press of this invention, the counterweight (G) is thusly arranged that its center of gravity ($S_u$) lies on the opposed side of the fulcrum (M) of the wobble movement as the center of gravity ($S_o$) of the first die half (1), and the product of the counterweight mass and its eccentricity spacing ($E_u$) relative to the fulcrum point (M) of the wobble movement at least approximately corresponds to the product of the mass of the first die half (1) and its eccentricity ($E_o$) relative to fulcrum point (M).

In a further embodiment of the wobble press of this invention, the counterweight (G) lies on the same side of the fulcrum (M) as the first die half, and the counterweight (G) is displaceable to the extent of the eccentric movement of the first die half to the opposite side of the longitudinal axis.

In an additional embodiment of the wobble press of this invention, the counterweight (G) consists of a material with a high specific weight, specifically over 10 g/cm$^2$. Preferably, the material is one of lead and tungsten carbide.

In yet another embodiment of the wobble press of this invention, a centering disk is arranged axially below and operatively interconnected with the first wobbling die half, the centering disk couplingly centering the first wobbling die half relative to the second die half. Preferably, the counterweight (G) is arranged axially below the centering plate and is connected with the first die half through openings in the centering plate. Again, preferably, the counterweight (G) annularly surrounds the second die half.

In still another embodiment of the wobble press of this invention, the wobble drive of the first die half has at least three pump-working piston-systems surrounding the wobble axis, and a multiple pump for supplying the pump-working piston-system with cyclically varying amounts of oil. Preferably, the multiple pump has two oppositely acting axial piston pumps at equal axial location.

In yet a further embodiment of the wobble press of this invention, both of the axial piston pumps each have a wobble plate of fixed angulation, as well as each having a number of pump pistons corresponding to the number of the working pistons, whose hydraulic conduits are connected in pairs with each other and with a pressure conduit of each assigned working piston. Preferably, means are included for the variation of the wobble stroke of the first die half, the means being provided via displacement of the phase location of both of the synchronously rotating pumps. This embodiment preferably also includes means for the variation of one of the number of revolutions and the direction of rotation of both pumps for attaining differing forms of wobble movement of the first die half.

In a differing embodiment of the wobble press of this invention, the counterweight (G) is arranged axially above the first die half and is connected with the first die half via means for connecting such that any displacement $E_o$ of the center of gravity $S_o$ of the first die half, in the radial direction, causes an inverse displacement $E_u$ of the center of gravity $S_u$ of the counterweight (G), with regard to the longitudinal axis A, so that the product of the mass of the first die half and its displacement $E_o$ at least approximately equals the product of the mass of the counterweight (G) and its displacement $E_u$, so that the centrifugal forces of the first die half and the counterweight (G) at least approximately compensate each other.

One embodiment of the means for connecting comprise a plurality of circumferentially spaced levers, with a first end of each of the levers being pivotally interconnected, via a first rod, with the counterweight (G) and a second end of each of the levers being pivotally interconnected, via a second rod, with the first die half. Preferably, the second rods are arranged at the center of gravity $S_o$ of the first die half, thereby eliminating tipping or tilting moments at the first die half.

Another embodiment of the means for connecting comprise a plurality of circumferentially spaced multiple piston/cylinder units, with a first one of said piston/cylinder units being interconnected, via a fist rod, with the counterweight and a second one of the piston/cylinder units being interconnected, via a second rod, with the first die half, the first and second piston/cylinder units being filled with a hydraulic medium and being hydraulically interconnected. Again, preferably, the second rods are arranged at the center of gravity $S_o$ of the first die half, thereby eliminating tipping or tilting moments at the first die half.

A further embodiment of the means for connecting comprises a plurality of circumferentially equally spaced flexible members including means for the directional reversal of each flexible member, with a first end of each of the flexible members being interconnected with the counterweight (G) and a second end of each of the flexible members being interconnected with the first die half. Again, preferably, the second ends of the flexible members are arranged at the center of gravity $S_o$ of the first die half, thereby eliminating tipping or tilting moments at the first die half. The flexible members preferably comprise a metal band, a metal cable or a metal chain, and the means for directed reversal preferably comprise a roller member, a pulley or a sprocket.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
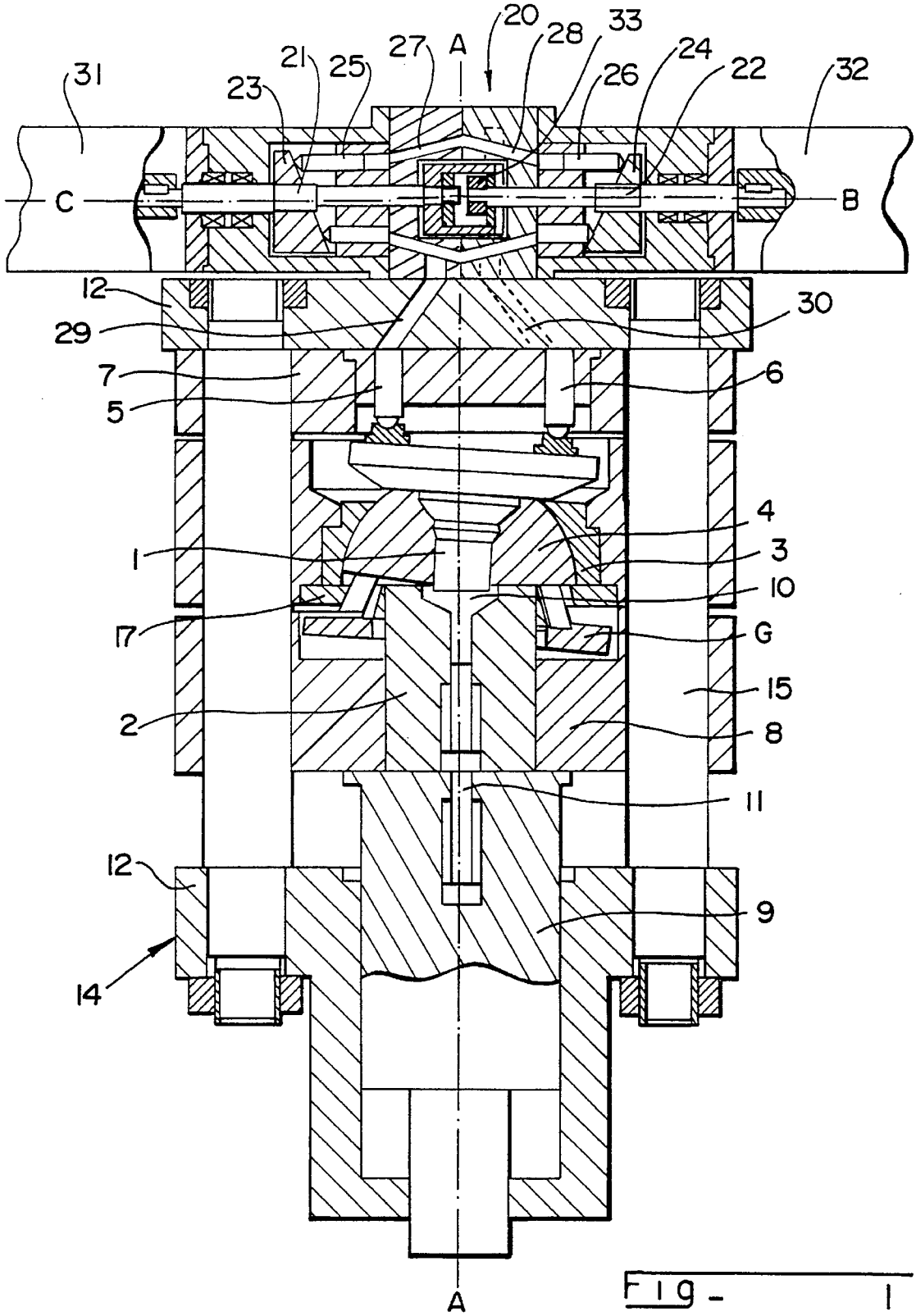
FIG. 1 is a wobble press in a longitudinal section taken along the wobble axis.
Figure 2:
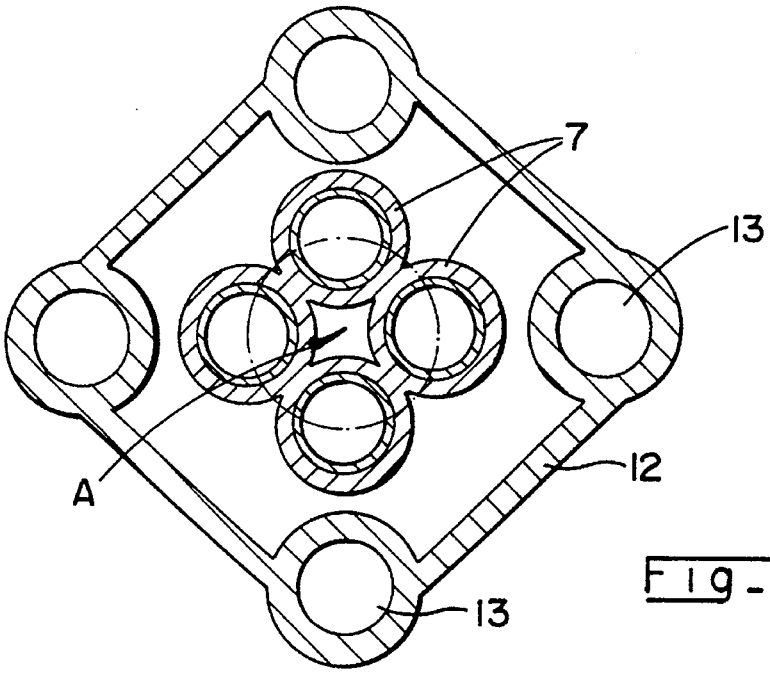
FIG. 2 is a cross-section of a wobble press of FIG. 1.

The wobble press shown in FIG. 1, having a wobble-driven upper or first die half 1 and an axially parallel moving lower or second die half 2 and a workpiece 10, located between both dies 1, 2 which is to be shaped, has a press frame 12, with built-in support rods 15, a press slide 8 as well as a hydraulic sliding drive movable via piston 9. The press frame absorbs the opposing force of the pressing force developed by the press slide 8 or rather hydraulic piston 9. Press frame 12 or rather support rods 15 is formed by an upper transom 7, a lower transom 14 and a number of rotationally symmetrical columns 13 placed around press axis A. As is shown in FIG. 2, for example, four such columns 13 can be provided. In place of a column frame, a box frame can also find use whereby a prismatic bed section is advantageous. The press slide 8 carries the fixed lower tool or die half 2 and is hydraulically pressed, via piston 9 against the wobbling upper tool or die half 1 retained in a workpiece holder 4.

The wobble movement of the upper die half 1 is produced through several, at least three touching working pistons 5, 6, working through the diameter of the movable tool holder 4 in cup 3 which pistons are impacted with a periodically sine shaped pulsating oil mass which is produced via a hydraulic multiple pump 20 with a plurality of pump piston 25, 26. Pump 20 is comprised of two axial piston pumps 21 residing in the same axial location perpendicular to the wobble axis, each driven via electric motor 31, 32 with controllable revolutions. Pumps 21, 22 work each with a surrounding dynamically balanced wobble plate 23, 24 respectively, to avoid centrifugal forces with wobble plates 23, 24 having a fixed inclination relative to drive axis B, respectively C in oppositely adjustable angle positions. Wobble plates 23, 24 cyclically move pump pistons 25, respectively 26 whose number corresponds to the number of working pistons 5, 6. Each pump piston 25 of one pump 21 is connected with the pump piston 26 of the other pump 22, in the same order, via hydraulic lines 27, 28 respectively connected and the hydraulic conduits 27, respectively 28, in turn are rigidly connected with pressure conduits 29, respectively 30, of the associated work piston 5, respectively 6.

With each revolution of the pump drive shaft, respectively of wobble disks 23, 24, respectively the flow of a pump piston pair 25, 26 increases from zero at an angle of 0° to a maximum at an angle of 180° and from thereon the fluid volume is reduced until it achieves an angle of 360°. The working piston 5 which is directly connected with pump piston 25, 26 via conduit 27, 28, 29, 30 imitates this sine-shaped movement and transmits it to the wobbling tool wherein the stroke size depends upon the ratio of cross section of the pump piston to the cross section of the wobble piston. If through corresponding control of the pump motors the phase location of the wobble plates is oppositely moved, a stepless regulation of the wobble stroke of the upper workpiece can be regulated from maximum at 0° difference of the phase locations of both pumps through zero at a difference of the opposing phase locations of 180°. The drive shafts 31, 32 of the wobble plates are driven via separate motors so that, in view of opposing variations of their revolutions, different forms of the wobble performance of upper workpiece 1 can be achieved.

Figure 6A:
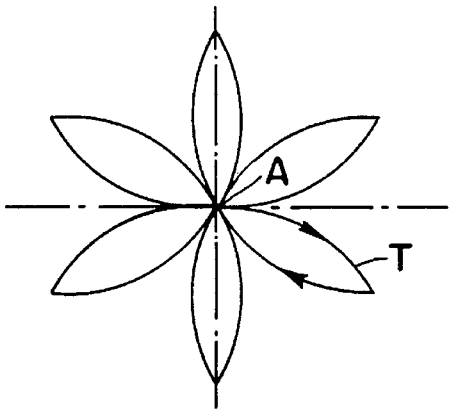
FIG. 6*a–d* show different possible wobble movements.
Figure 6B:
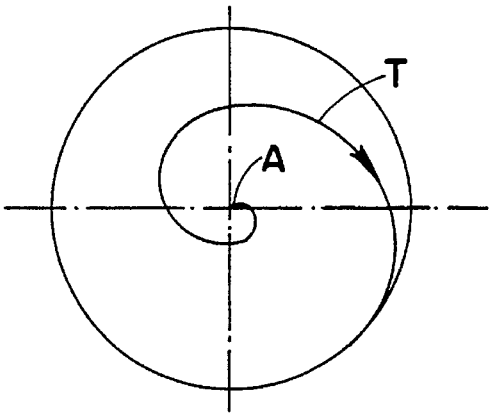
Figure 6C:
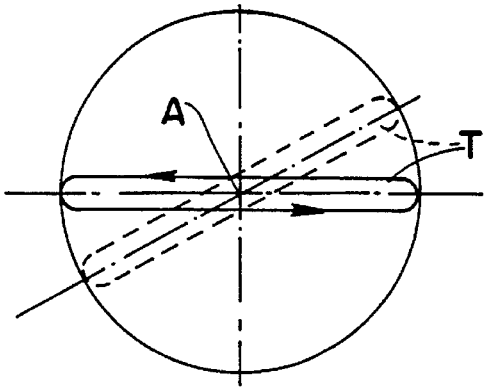
Figure 6D:
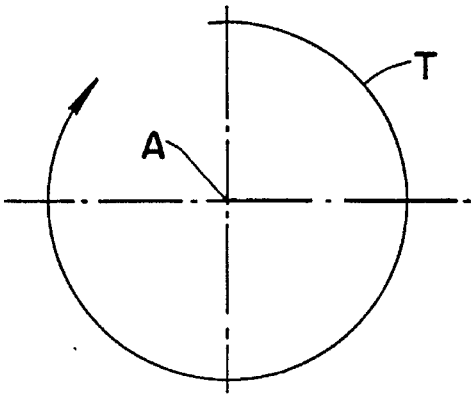

Through variation of the numbers of revolutions and the direction of rotation of pump drive motors 31, 32 all desired forms of a wobble development can be produced. FIG. 6*a* shows as example a star shaped, FIG. 6*b* a spiral shaped, FIG. 6*c* a nearly linear movement in a direction of choice, and FIGS. 6*d* a circular wobble movement T relative to wobble axis A. Due to the benefit of the minimal rotating masses and the electronic control of pump drive members 31, 32 different variations can be programmed and can be utilized within one and the same shaping operation under load.

With axial piston pumps of the described type high axial forces are encountered which are normally received via axial anti-frictions bearings. With revolutions over 2,000 rpm, the life span of such bearings is limited. With the inventive arrangement this axial load, at the ends of the pump shaft is reciprocally supported wherein, due to possible difference in the number of revolutions, a pressure bearing 33 takes over the support.

Figure 3:
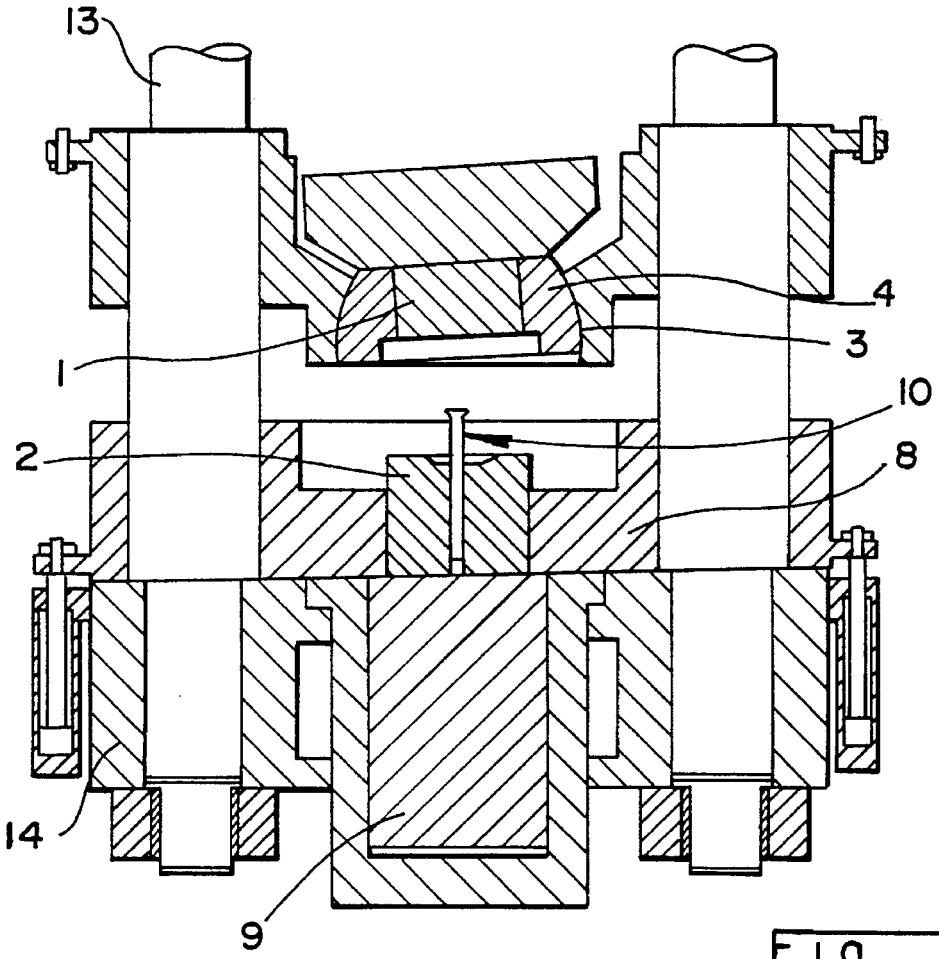
FIG. 3 is a segment of the longitudinal section of the press.

The workpiece holder 4, as best shown in the enlarged recitation in FIG. 3, is formed in a cup shape so that the wobbling upper die half 1 is centered relative to fixed lower die half 2. Thus, the opposing pressure of the lower die half 1 is not absorbed in the cup shaped workpiece holder 4 or its guidance or cup 3 but rather by the hydraulic medium in working cylinders 5, 6.

Lower die half 2 is retained in press slide 8 which is movable via piston 9. Piston 9 includes, in addition, a hydraulically actuated ejection piston 11 for workpiece 10.

Figure 4:
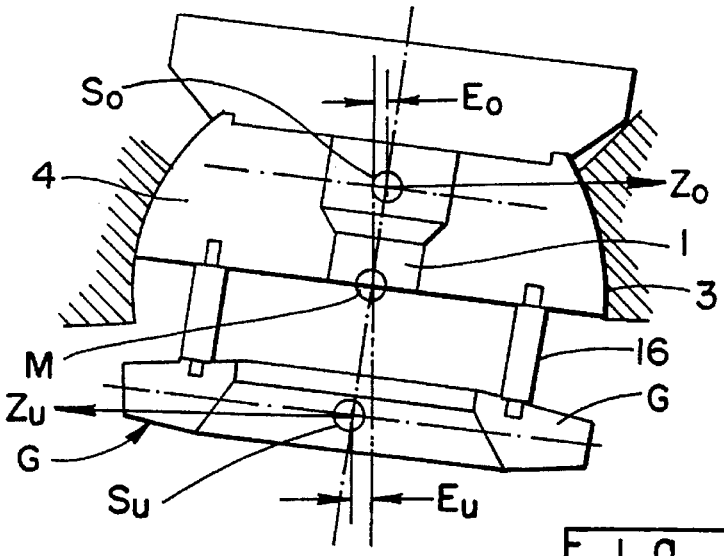
FIG. 4 is a detailed representation of the elimination of centrifugal forces.
Figure 5:
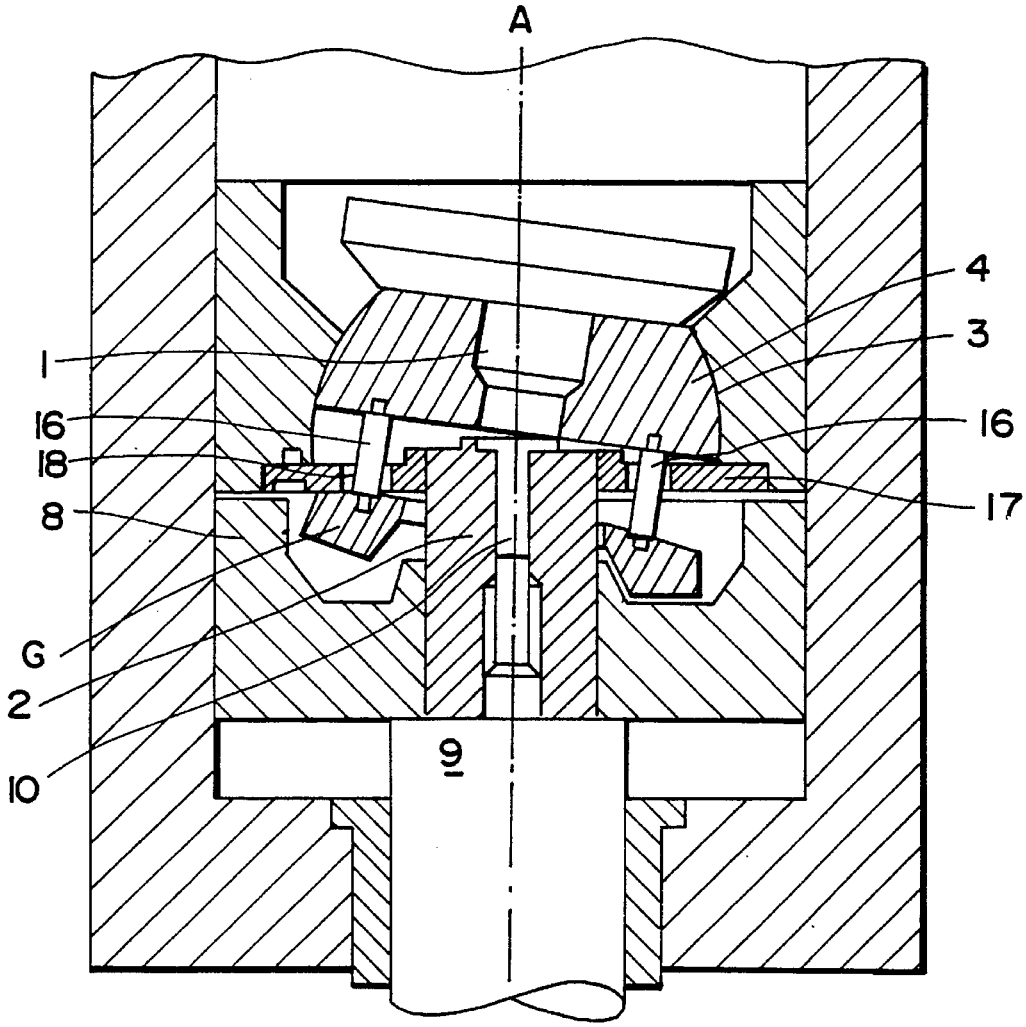
FIG. 5 is a detailed representation of the die guidance.

FIG. 4 and 5 portray, in detail the construction of the upper wobbling die half 1 in which all centrifugal forces, produced during the operation thereof are compensated. The magnitude of these centrifugal forces $Z_o$, on the upper die half 1, is determined through the eccentricity $E_o$ of the center of gravity $S_o$ relative to press axis A. For compensation of the centrifugal force in this embodiment, a counterweight G is attached axially below the upper wobbling die half 1 having a center of gravity displaced 180°. The eccentricity $E_u$ and the center of gravity $S_u$ of counterweight G are so chosen so that a centrifugal force $Z_u$ is achieved in the same magnitude as the centrifugal force $Z_o$ of die half 1. For that purpose the product of the distance $E_u$ of the center of gravity $S_u$ of counterweight G from fulcrum M is chosen preferably the same as the corresponding product of the wobbly driven upper die half 1. The resultant of both centrifugal forces $Z_o$ and $Z_u$, is perpendicular to axis A then approaches zero and is indeed independent of the angle of inclination of the upper tool and of the wobble frequency. The moment produced via the axial pistons of both centrifugal forces can then be taken up without difficulty via the drive of the wobble movement.

Figure 7:
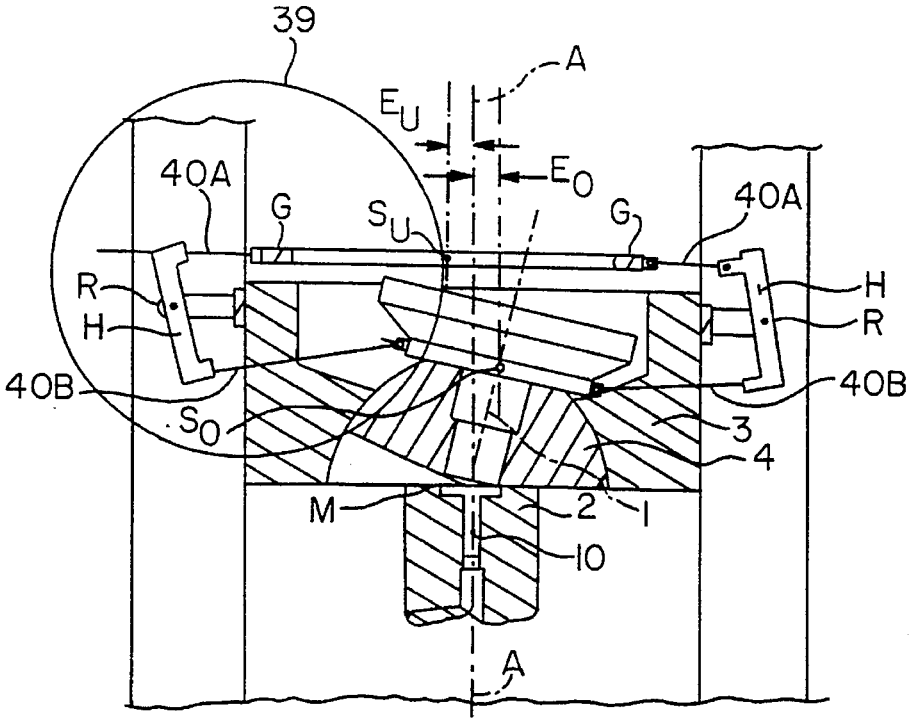
FIG. 7 is a detailed representation of a further embodiment for the elimination of centrifugal forces.
Figure 8:
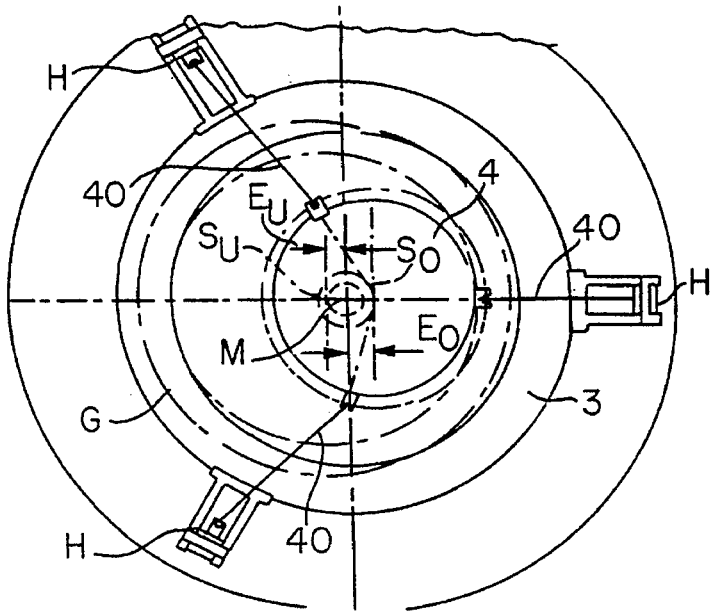
FIG. 8 is a schematic cross section of the embodiment of FIG. 7.

In another variation or embodiment of this invention, shown in FIGS. 7 and 8, and in which like parts use the same reference numerals as those in FIGS. 1–5, the compensation of the natural forces of the wobbling tool 1 can be achieved in that a movable mass or counterweight G is provided on the same side of the fulcrum M of tool 1. Through a movement of counterweight G, to the extent of the eccentric deflection of tool 1 to the opposing side of central press axis A, the required opposing force can be achieved whereby the movement of countermass G is achieved via a lever structure as a function of the eccentric deflection.

Specifically, the structure of FIGS. 7 and 8 utilizes a lever structure consisting of three equally circumferentially spaced (120 degree separation) pivotable levers H, pivotable at a point of rotation R, with one end of each lever H being interconnected on one end, via a first rod 40*a*, to counterweight G and another end of each lever H being interconnected, via a second rod 40*b*, to upper die half 1. The effect is such that any displacement $E_o$ of the center of gravity $S_o$ of upper die half 1 in the radial direction, causes an inverse displacement $E_u$ of the center of gravity $S_u$ of counterweight G, with regard to press axis A, in such a way that the product of the mass of upper die half 1 and its displacement $E_o$ is equal to the product of the mass of counterweight G and its displacement $E_u$. Thus, the centrifugal forces of wobbling die half 1 and of counterweight G balance each other.

In other words, in the FIG. 7 and 8 embodiment, the eccentric movement or displacement $E_u$ of the center of gravity $S_o$ of the mass of first die half or upper tool 1 is transferred via three first or upper rods 40*a* and three second or lower rods 40*b* together with their associated levers H to counterweight G, whereby the direction of the radial angular displacement or swing of first die half 1, relative to longitudinal central press axis A is reversed. Rods 40*a*, 40*b* displace in the same manner or to the same extent the ring-shaped or annular counterweight G, which is freely floatingly suspended, proportionally opposite to first die half 1, so that the product of the mass of counterweight G times the eccentric displacement $E_u$ of counterweight G equals the product of the mass of first die half 1 times the displacement $E_o$ of first die half 1 and the resultants are zero.

This dynamic balance is in effect for all values of the displacement or eccentricity $E_o$ and for all wobble frequencies. Additionally, and importantly so, an additional advantage is achieved if rods 40 are arranged at the height of the center of gravity $S_o$ of wobbling first die half 1 then there is no tipping or tilting moment at first die half 1.

Instead of the previously described lever structure or system of FIGS. 7 and 8, as best seen in circled area 39 of FIG. 7, for connecting upper die half 1 and counterweight G, any other desired type of movement-reversing arrangement or means, be they mechanical, hydraulic or electrical, etc., may be utilized.

Figure 9:
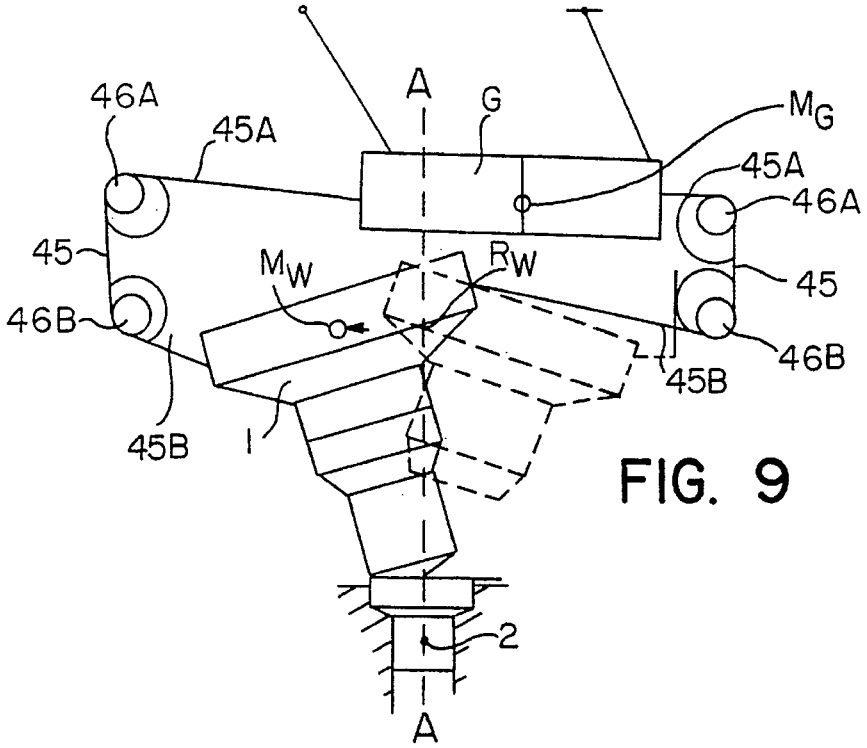
FIG. 9 is a schematic representation of a differing embodiment of a connecting means.

Another device for compensating the rotating inertia forces in the upper die half 1 is shown in FIG. 9. The movement of the rotating mass $M_w$ of the upper die half 1 is directly transferred to the counterweight G via a flexible connection 45 in the form of a band, chain or cable, etc. The two band halves 45*a* and 45*b*, together with couterweight G and the mass of upper die half 1, form an endless loop around reversing rolls 46*a* and 46*b*. One of each of the ends of the two band halves 45*b* is connected with the mass of the upper die half 1 at a distance $R_w$ relative to the vertical cutting plane of the tool axis and the rotating axis A with the analogous plane of the center of gravity $M_g$ of the counterweight G so that, during a displacement or deflection of the upper die half 1, for example to the left, the counterweight G must make an analogous displacement or gyrating movement to the right. In order that the rotating or gyrating movement of the center of gravity is covered in all directions, one each of the noted band-roll arrangements is attached at three points of the periphery. In the previously described manner it is assured that the rotational speed of the eccentric movements as well as the eccentric displacements are transferred at all settings.

Figure 10:
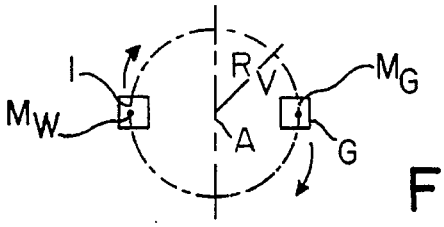
FIG. 10 illustrates the operating principle of the FIG. 9 embodiment.

FIG. 10 illustrates the operating principle of the FIG. 9 arrangement, wherein counterweight G with its center of gravity $M_g$ is always rotating around axis A in opposition to upper die half 1 with its center of gravity $M_w$ around axis A at a radius $R_v$.

The present invention is not restricted to a pure mechanical transfer of the movement of upper die half 1 to couterweight G. Instead of such a mechanical transfer, this movement may also be transferred by means of a suitable hydraulic or electric arrangement, with an example of the former being shown in FIG. 11 in a schematic manner.

Figure 11:
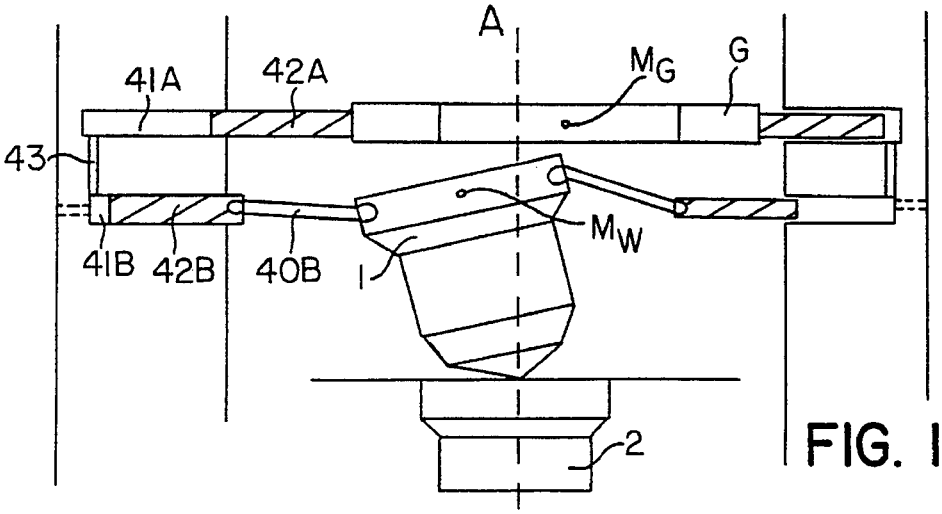
FIG. 11 is a schematic representation of a yet further differing embodiment of the connecting means of this invention.

In the FIG. 11 embodiment, the movement of upper die half 1 is transferred via a rod 40*b* to a piston 42*b* which is movable within a cylinder 41*b* filled with hydraulic fluid. Cylinder 41*b* is connected via a conduit 43 with a counter cylinder 41*a* in which a piston 42*a* is movable, the movement of which is directly transferred to counterweight G. Therein, the end effect is substantially the same as that of the previously described mechanical connection. In this embodiment, the piston/cylinder pairs may also be arranged around the periphery, as previously noted.

In place of previously described hydraulic/cylinder arrangement 41*b*, 42*b*, an electrically driven linear displacement device, cooperating with said sensor, may also be utilized.

The described compensation of the centrifugal forces permits, together with the other described requirements a striking increase in the wobble frequency of values up to approximately 2400 revolutions per minute and permits the reduction of the shaping time of the workpiece to a normal value used in drop-forging in mechanical presses, that is a noticeable increase in manufacturing output as well as the use of increased temperature of about 800° to about 1100° without excessive heating of the tools and without premature cooling of the workpiece.

In order that counterweight G takes the least possible room and is easy to store it is advantageously made of a material of a high specific weight for example from lead or other heavy metals or tungsten carbide.

In the embodiments of FIGS. 1–5, for the maintenance of the eccentric position of both die halves and for workpieces with considerable unsymmetrical material distribution the rigidity of the opposing guidance is of considerable importance. In order to reduce the clearance in the guidance of press slide 8 and to possibly eliminate the same, a direct centering is provided. For that, a centering disk 17 is directly connected with the tool holder of the upper die half which practically fits without clearance on the outer diameter of lower die half 2 and which makes a rigid connection during the deformation process. During the last portion of the deformation cycle lower die half 2 enters into centering disk 17 and assures even with noncentered workpiece material distribution the adherence of very close tolerances with reference to the axial displacement, that is even nonrotational-symmetrical distribution of the workpiece cross section assures direct tool guidance, the exact adherence of the coincidence of the axes of the two die halves.

In the embodiments of FIGS. 1–5, counterweight G, which serves for the balancing of the centrifugal forces, is in this instance shaped as a ring and connected with wobbling upper die 1 with a plurality of spacer bolts 16. Openings or slits 16 of desired form, in centering disk 17 permit the swinging movement of spacer bolts 16.

It should be understood that all embodiments of this invention reduce or avoid the centrifugal forces caused by the eccentricity of the center of gravity of the upper die half during the wobbling movement of upper die 1.

However, the embodiments of this invention where counterweight G is located on the same side of the fulcrum M of tool 1, namely the embodiments shown in FIGS. 7–10 respectively, these constructions also reduce the tilting moments which occur during the wobbling movement due to the inclination of the tool of upper die half 1 with respect to longitudinal press axis A.

The several described embodiments are particularly advantageous with hydraulic drive since a highly stressed axial bearing is not required which at high rotational speeds would only have a short life span. The smooth running is distinctly increased and higher revolutions can be achieved in continuing operation. Through changes in the speed and the direction of rotation or movement of the phases of the two pumps, the opposing movements of both tools can readily be accommodated to technological requirements and one can depending on requirement realize, without difficulty, circular movements, spiral movements, vibratory movements or rotational movements wherein the extent of the wobble inclination and also the input of the differing movement programs can be preprogrammed and controlled without the loss of time. The upsetting process can, for example, be started with the upper tool at rest and can without delay be brought up to the desired wobble stroke.

At the end of each testing process the warm hydraulic medium circulating between the pump and the working pistons can be flushed out and possible leakages at the end of the press piston hub can be compensated for via a filling suction valve. The pressure oil heated in the process of a press cycle can at the end of the cycle be cooled with a suitable oil cooler.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A wobble press comprising in combination: a first die half; a movable second die half axially parallel relative to the first die half; means for wobbly driving said first die half, having a mass and a center of gravity, with regard to a longitudinal central axis of said press, wobbly around a fulcrum point, said wobble drive means including hydraulic working pistons which are provided with a regular, defined, pulsating flow of hydraulic medium, said hydraulic working pistons being connected with said first die half for the generation of a wobble movement; a counterweight, having a mass and a center of gravity, connected to said first wobbly driven die half, said counterweight being so structured and arranged that the product of the mass of said counterweight and the eccentricity spacing, of the spacing of the center of gravity of said counterweight, relative to a longitudinal axis, at least approximately corresponds to the product of the mass of said first die half and the eccentricity spacing, of the spacing of the center of gravity of said first die half, relative to said longitudinal axis, so that the centrifugal forces of both said counterweight and said first die half at least approximately compensate each other; said counterweight lying on the same side of the fulcrum as said first die half and displaceable to the extent of eccentric movement of said first die half to an opposite side of said longitudinal axis.

2. The wobble press of claim 1 wherein said counterweight consists of a material with a high specific weight, specifically over 10 g/cm$^2$.

3. The wobble press of claim 2 wherein said material is one of lead and tungsten carbide.

4. The wobble press of claim 1 wherein said counterweight is arranged axially above said first die half and is connected with said first die half via means for connecting such that any displacement of the center of gravity of said first die half, in the radial direction, causes an inverse displacement of the center of gravity of said counterweight, with regard to said longitudinal axis, so that the product of the mass of said first die half and its displacement at least approximately equals the product of the mass of said counterweight and its displacement, so that the centrifugal forces of said first die half and said counterweight at least approximately compensate each other.

5. The wobble press of claim 4 wherein said means for connecting comprise a plurality of circumferentially spaced levers, with a first end of each of said levers being pivotally interconnected, via a first rod, with said counterweight and a second end of each of said levers being pivotally interconnected, via a second rod, with said first die half.

6. The wobble press of claim 5 wherein said second rods are arranged at the center of gravity of said first die half, thereby eliminating tipping or tilting moments at said first die half.

7. The wobble press of claim 4 wherein said means for connecting comprise a plurality of circumferentially spaced multiple piston/cylinder units, with a first one of said piston/cylinder units being interconnected, via a fist rod, with said counterweight and a second one of said piston/cylinder units being interconnected, via a second rod, with said first die half, said first and second piston/cylinder units being filled with a hydraulic medium and being hydraulically interconnected.

8. The wobble press of claim 7 wherein said second rods are arranged at the center of gravity of said first die half, thereby eliminating tipping or tilting moments at said first die half.

9. The wobble press of claim 4 wherein said means for connecting comprises a plurality of circumferentially equally spaced flexible members including means for the directional reversal of each flexible member, with a first end of each of said flexible members being interconnected with said counterweight and a second end of each of said flexible members being interconnected with said first die half.

10. The wobble press of claim 9 wherein said second ends of said flexible members are arranged at the center of gravity of said first die half, thereby eliminating tipping or tilting moments at said first die half.

11. The wobble press of claim 9 wherein said flexible members comprise a metal band and said means for directed reversal comprises a roller member.

12. The wobble press of claim 9 wherein said flexible members comprise a metal cable and said means for directed reversal comprises a pulley.

13. The wobble press of claim 9 wherein said flexible members comprise a metal chain and said means for directed reversal comprises a sprocket.

* * * * *